US008187781B2

(12) United States Patent
Kobayashi et al.

(10) Patent No.: US 8,187,781 B2
(45) Date of Patent: May 29, 2012

(54) RESIN-FILLED FERRITE CARRIER FOR ELECTROPHOTOGRAPHIC DEVELOPER, PRODUCTION METHOD THEREOF AND ELECTROPHOTOGRAPHIC DEVELOPER USING THE FERRITE CARRIER

(75) Inventors: Hiromichi Kobayashi, Chiba (JP); Takao Sugiura, Chiba (JP)

(73) Assignee: Powdertech Co., Ltd., Chiba (JP)

( * ) Notice: Subject to any disclaimer, the term of this patent is extended or adjusted under 35 U.S.C. 154(b) by 998 days.

(21) Appl. No.: 12/041,836

(22) Filed: Mar. 4, 2008

(65) Prior Publication Data

US 2008/0241726 A1 Oct. 2, 2008

(30) Foreign Application Priority Data

Mar. 29, 2007 (JP) ..... 2007-086438

(51) Int. Cl.
*G03G 9/00* (2006.01)

(52) U.S. Cl. ..... 430/111.31; 430/111.3; 430/111.35

(58) Field of Classification Search ..... 430/111.3, 430/111.31, 111.35
See application file for complete search history.

(56) References Cited

U.S. PATENT DOCUMENTS

| | | | | |
|---|---|---|---|---|
| 5,256,511 | A * | 10/1993 | Matsumura et al. | 430/111.1 |
| 5,670,287 | A * | 9/1997 | Kawata et al. | 430/111.32 |
| 5,989,767 | A * | 11/1999 | Yoerger et al. | 430/111.32 |
| 6,528,225 | B1 | 3/2003 | Mahabadi et al. | |
| 6,660,444 | B2 | 12/2003 | Mahabadi et al. | |
| 2003/0104303 | A1 | 6/2003 | Mahabadi et al. | |
| 2006/0269862 | A1 * | 11/2006 | Kobayashi et al. | 430/111.31 |
| 2007/0048649 | A1 | 3/2007 | Kobayashi et al. | |

FOREIGN PATENT DOCUMENTS

| | | |
|---|---|---|
| JP | 3-229271 | 10/1991 |
| JP | 5-100492 | 4/1993 |
| JP | 5-173371 | 7/1993 |
| JP | 11-295933 | 10/1999 |
| JP | 2002-091091 | 3/2002 |
| JP | 2004-077568 | 3/2004 |
| JP | 2006-337579 | 12/2006 |
| JP | 2007-057943 | 3/2007 |

OTHER PUBLICATIONS

U.S. Appl. No. 12/033,384, filed Feb. 19, 2007, Kobayashi et al.
English language Abstract of JP 11-295933.
English language Abstract of JP 2006-337579.
English language Abstract of JP 2007-057943.
English language Abstract of JP 3-229271.
English language Abstract of JP 2004-077568.
English language Abstract of JP 5-100492.
English language Abstract of JP 5-173371.
English language Abstract of JP 2002-091091.

* cited by examiner

*Primary Examiner* — Mark F Huff
*Assistant Examiner* — Stewart Fraser
(74) *Attorney, Agent, or Firm* — Greenblum & Bernstein, PLC

(57) ABSTRACT

Employed are a resin-filled ferrite carrier for an electrophotographic developer filled with a resin in voids of a porous ferrite core material, wherein the resin filled in the voids is a silicone resin which has a softening point of 40° C. or above and is cured at or above such softening point, and the filled amount is 7 to 30 parts by weight based on 100 parts by weight of the core material, a method for producing thereof band an electrophotographic developer using this ferrite carrier.

17 Claims, No Drawings

RESIN-FILLED FERRITE CARRIER FOR ELECTROPHOTOGRAPHIC DEVELOPER, PRODUCTION METHOD THEREOF AND ELECTROPHOTOGRAPHIC DEVELOPER USING THE FERRITE CARRIER

BACKGROUND OF THE INVENTION

1. Field of the Invention

The present invention relates to a resin-filled ferrite carrier for an electrophotographic developer used in a two-component electrophotographic developer used in copiers, printers and the like, a production method thereof and an electrophotographic developer using this ferrite carrier. More specifically, the present invention relates to a resin-filled ferrite carrier for an electrophotographic developer having a lightened true density and a lengthened life, and which can ensure the stability of the charge properties and which is free from image defects such as white spots, a production method thereof and an electrophotographic developer using this ferrite carrier.

2. Description of the Related Art

Electrophotographic developing methods develop by adhering toner particles in a developer to an electrostatic latent image which is formed on a photoreceptor. The developer used in such methods can be classified as either being a two-component developer composed of toner particles and carrier particles, or a one-component developer which only uses toner particles.

Among such developers, as the developing method using a two-component developer composed of toner particles and carrier particles, a cascade method or the like has long been employed. However, currently magnetic brush methods using a magnet roll have become mainstream.

In a two-component developer, carrier particles act as a carrying substance for imparting the desired charge to the toner particles and transporting the thus-imparted toner particles with a charge to the surface of the photoreceptor to form a toner image on the photoreceptor by stirring the carrier particles with the toner particles in a developing box which is filled with the developer. Carrier particles remaining on the developing roll which supports the magnets return back into the developing box from this developing roll, and are then mixed and stirred with new toner particles for reuse over a certain time period.

Unlike one-component developers, in two-component developers the carrier particles are mixed and stirred with the toner particles to charge the toner particles. The carrier particles also have a transporting function and are easily controlled when designing the developer. Therefore, two-component developers are suitable for full color developing apparatuses in which high image quality is demanded and for apparatuses performing high-speed printing in which the reliability and durability of image sustainability are demanded.

In two-component developers which are used in such a manner, the image properties, such as image density, fogging, white spots, gradation and resolution, need to exhibit a certain value from the initial stage. Furthermore, these properties must not change during printing and have to be stably maintained. To stably maintain these properties, it is necessary for the properties of the carrier particles in the two-component developer to be stable.

Conventionally, an iron powder carrier, such as iron powder covered with an oxide coating on its surface or iron powder coated with a resin on its surface, has been used for the carrier particles forming a two-component developer. These iron powder carriers have high magnetization as well as high conductance, and thus have the advantage that an image with good reproducibility of the solid portions can be easily obtained.

However, the true specific gravity of such an iron powder carrier is about 7.8, which is heavy, and its magnetization is too high. As a consequence, the toner constituent component tends to fuse to the surface of the iron powder carrier, so-called "toner spent", from the stirring and mixing with the toner particles in the developing box. Due to the occurrence of toner spent, the effective carrier surface area decreases, whereby the frictional chargeability with the toner particles tends to deteriorate.

With a resin-coated iron powder carrier, the resin on the surface may peel away due to stress during use, causing charge to leak as a result of the high conductance, low dielectric breakdown voltage core material (iron powder) being exposed. The electrostatic latent image formed on the photoreceptor breaks down as a result of such charge leakage, thus causing brush strokes or the like to occur on the solid portions, which makes it difficult to obtain a uniform image. For these reasons, iron powder carriers, such as an oxide-coated iron powder or a resin-coated iron powder, are currently no longer used.

Recently, instead of iron powder carriers, resin-coated ferrite carriers coated with a resin on their surface are often used which use a ferrite core material having a light true specific gravity of about 5.0 and a low magnetization, whereby developer life has become dramatically longer.

However, in recent years the workplace has become more networked, evolving from an era of single-function copiers to multifunction devices. In addition, the type of service provided has shifted from a system wherein a contracted repair worker carries out regular maintenance and replaces the developer and other parts to a maintenance-free system. Further, demands from the market for even longer developer life are becoming much greater.

Further, full color images are now standard in the workplace, so that there is an increasing demand for higher quality images. Toner particle size is also decreasing in order to obtain higher resolution.

In response to these demands, the carrier particle size is also shifting towards a smaller particle size having a higher specific surface area, as it is necessary for the desired charge to be quickly charged onto the toner. If the overall particle size distribution moves to a smaller particle size, the particles on the finer powder size, especially, are more likely to scatter or adhere to the photoreceptor, so-called "carrier adhesion". As a result, critical image defects such as white out are more easily induced. Therefore, small particle size carriers must be controlled to have an even narrower particle size distribution width.

In view of these circumstances, many proposals have been made concerning magnetic powder-dispersed carriers in which fine, magnetic microparticles are dispersed in a resin to extend developer life by making the carrier particles lighter.

Such a magnetic powder-dispersed carrier can reduce true density by reducing the amount of magnetic microparticles, thus reducing the stress from stirring. As a result, chipping or peeling of the coating can be prevented, whereby stable image properties for a long period of time can be obtained.

However, because a binder resin covers the magnetic microparticles, the magnetic powder-dispersed carrier has a high carrier resistance. Thus, there is the drawback that it is difficult to obtain sufficient image density.

In addition, since the magnetic microparticles are hardened by the binder resin, the magnetic powder-dispersed carrier has also had the drawbacks that the magnetic microparticles detach due to stirring stress or from shocks in the developing apparatus, and that the carrier particles themselves split, possibly as a result of having inferior mechanical strength as compared with the conventionally-used iron powder carrier or a ferrite carrier. The detached magnetic microparticles or split carrier particles adhere to the photoreceptor, thereby becoming a factor in causing image defects.

Further, a magnetic powder-dispersed carrier has the drawback that since fine magnetic microparticles are used, remnant magnetization and coercive force increase, so that the fluidity of the developer deteriorates. Especially when a magnetic brush is formed on a magnet roll, the bristles of the magnetic brush stiffen due to the presence of remnant magnetization and coercive force, which makes it difficult to obtain high image quality. There is also the problem that even when the carrier leaves the magnet roll, because the carrier magnetic agglomerations do not come unloose and the carrier cannot be rapidly mixed with the supplied toner, the rise in the charge amount is poor, which causes image defects such as toner scattering and fogging.

A resin-filled carrier in which the voids in a porous carrier core material are filled with a resin has been proposed as a replacement for magnetic powder-dispersed carriers. For example, Japanese Patent Laid-Open No. 11-295933 describes a carrier which comprises a polymer contained in the pores of cores, and a coating which covers the cores. These resin-filled carriers enable a carrier to be obtained having few shocks, a desired fluidity, a broad range of frictional charge values, a desired conductance and a volume average particle size that is within a certain range.

Japanese Patent Laid-Open No. 11-295933 describes that various suitable porous solid core carrier substances, such as a known porous core, may be used as the core material.

However, as is described in the examples of Japanese Patent Laid-Open No. 11-295933, for a porosity of about 1,600 $cm^2/g$ in BET surface area, a sufficient reduction in the specific gravity is not achieved even by filling with a resin.

If a large amount of resin is filled into a core material, the resin which could not be filled remains by itself without closely adhering to the core material. In such a state, the left-over resin floats in the carrier, causing a large amount of agglomerates to form among the particles, whereby fluidity deteriorates. When agglomerates break apart during use, charge properties fluctuate greatly, making it difficult to obtain stable properties.

Further, in Japanese Patent Laid-Open No. 11-295933, a porous core is used, and the total content of the resin filled in the cores and the resin which coats the surface of the cores is preferably about 0.5 to 10% by weight of the carrier. In the examples of Japanese Patent Laid-Open No. 11-295933, the greatest total content of the resins does not even reach 6% by weight of the carrier. With such a small amount of resin, the desired low specific gravity cannot be realized, meaning that a performance that is merely approximate to that of the conventionally used resin-coated carrier is obtained.

Additionally, the carrier described in Japanese Patent Laid-Open No. 11-295933 not only has a core material which is insufficiently porous, but the amount of filled resin is also insufficient, and thus a resin-filled carrier having a three-dimensional layer structure in which a resin layer and a ferrite layer are alternately present cannot be obtained. The present inventors discovered that a resin-filled carrier having a three-dimensional layer structure in which a resin layer and a ferrite layer are alternately present a plurality of times can be obtained by filling resin into the voids of a porous ferrite core material wherein the voids are continuous from the surface through to the core material interior. The term "three-dimensional layer structure" as used here refers to, in a carrier particle cross section, a structure in which a plurality of resin layers and ferrite layers alternate with each other from one end to the other along a straight line (diameter) drawn passing through the center of the particle. The present inventors discovered that by forming such a three-dimensional layer structure, due to the retention of a capacitor-type nature, the structure has excellent charging capability and stability, yet has a high strength as compared to a magnetic powder-dispersed carrier. As a result, the structure has the advantage of not splitting, deforming or melting from heat or shocks.

While the carrier disclosed in Japanese Patent Laid-Open No. 11-295933 fills a resin or a fine powder consisting of an electrical insulating resin, essentially the way in which this is carried out is to merely increase the amount of resin in a carrier having a surface of a conventionally-known core coated by a resin, and just a tiny amount of this seeps into the voids. Charging capability and stability are not at a satisfactory level.

Japanese Patent Laid-Open No. 2006-337579 proposes a resin-filled carrier wherein a resin is filled in a ferrite core material having a void fraction of 10 to 60%. In Japanese Patent Laid-Open No. 2006-337579, because the carrier is filled with a resin, it has a lighter true density, can achieve a longer life and has excellent fluidity. Further, depending on the selection of the resin which is filled, it is easy to control the amount of charge or the like, yet the carrier is stronger than a magnetic powder-dispersed carrier, so that there is no splitting, deforming or melting from heat or shocks. This filled carrier overcomes the problems of the resin-filled carrier described in the above Japanese Patent Laid-Open No. 11-295933.

Further, Japanese Patent Laid-Open No. 2007-57943 discloses a carrier for an electrophotographic developer which is a resin-filled ferrite carrier filled with a resin in the voids of a porous ferrite core material which are continuous from the surface through to the interior, and the carrier has a plurality of three-dimensional layer structures in which a resin layer and a ferrite layer are alternately present. In the working examples of Japanese Patent Laid-Open No. 2007-57943, an example is described wherein 12 to 20 parts by weight of a condensation-crosslinking silicone resin are filled per 100 parts by weight of ferrite core material.

If such a large amount of resin is filled into a porous ferrite core material, some of the resin cannot be filled. This resin is present without closely adhering to the core material, so that there is the problem that the frictional charge with the toner is hindered.

Further, in some cases the floating resin microparticles move onto the electrostatic latent image, leading to image defects such as white spots. In addition, the amount of such floating resin microparticles is different each time the resin-filled carrier is produced, leading to variation in developer characteristics, which dramatically decreases production stability.

Regarding the resin which is filled into or coated onto the carrier core material, and the coated amount, for example, Japanese Patent Laid-Open No. 3-229271 discloses a carrier for an electrophotographic developer which is produced by forming uneven portions on the surface of carrier core particles having a void surface area along a cross-section which includes the major axis of less than 10% by corroding with an acid or alkali, and coating the surface with a resin. Comparative example 2 of Japanese Patent Laid-Open No. 3-229271 describes a core material composed of ferrite particles having a void surface area along a cross-section which includes the major axis of 17.8%, a specific surface area of 915 $cm^2/g$ and an average particle size of 95 μm which were treated in hydrochloric acid solution, and a carrier composed of such core material which was coated with an alkaline resin. As also described in the comparative examples of Japanese Patent Laid-Open No. 3-229271, sufficient charge stability could not be obtained with a carrier that had simply been coated with an alkaline resin. Japanese Patent Laid-Open No. 3-229271 contains no specific disclosure concerning the amount of applied resin coating, and also has no teaching concerning the properties of the applied resin. Therefore, although the reason for the charge properties being unstable is uncertain, it can be considered that if a large amount of resin is coated onto a ferrite core material whose specific surface area does not even at most reach 1,400 $cm^2/g$, there is a large amount of floating resin which is not closely adhered to the core material, which becomes a factor in the lack of charge stability. Further, although the average particle size of the carrier described in Comparative example 2 of Japanese Patent Laid-Open No. 3-229271 is about 95 μm, with a carrier having such a large particle size it is difficult to obtain a charging capability which can cope with the recent trend towards a smaller toner particle size.

Japanese Patent Laid-Open No. 2004-77568 discloses a resin-coated carrier for an electrophotographic developer formed with a resin-coated layer on the surface of the carrier core material, wherein the carrier has, on the surface and in the interior of a porous magnetic body with a weight average particle size of 20 to 45 μm, a high resistance substance whose resistance is higher than that of the porous magnetic body itself, and a resistance Log R when applying 5,000 V of 10.0 Ωcm or more.

In Working example 3 of Japanese Patent Laid-Open No. 2004-77568, an example is described in which the steps of mixing 5 kg of core material, 150 g of methyl methacrylate and 5 kg of toluene and then spray drying the mixture are repeated twice, followed by forming a coat of about 0.5 μm with a silicone resin. Specifically, the carrier described in Japanese Patent Laid-Open No. 2004-77568 is such that a resin treatment of at most 6% by weight is carried out on the porous magnetic body particles. With such an amount of resin, it is difficult to achieve a lower specific weight, which makes it difficult to stabilize the charge properties and attain a longer life. Further, the coating resin described in this publication (silicone resin SR-2411) does not have a softening point, so that the occurrence of floating resin cannot be prevented by a method such as that described below in the present invention, and is thus unsuitable for stabilization of charge amount.

In the above-described Japanese Patent Laid-Open Nos. 11-295933, 2006-337579, 2007-57943, 3-229271 and 2004-77568, various types of resin such as those described above are disclosed as examples of the resin for filling or coating. However, there is no disclosure in Japanese Patent Laid-Open Nos. 11-295933, 2006-337579, 2007-57943, 3-229271 or 2004-77568 concerning the softening temperature or curing temperature of the used resin, and merely describe which resins may be used.

For example, in Japanese Patent Laid-Open No. 2006-337579, the condensation-crosslinkable silicone resin SR-2411 (manufactured by Dow Corning Toray Co., Ltd.) and a thermoplastic acrylic resin (manufactured by Mitsubishi Rayon Co., Ltd.) are used. With such resins, when a large amount of resin is filled, a large amount of floating resin that is not closely adhered to the core material may occur, which is believed to be a factor in the lack of charge stability.

In addition, there have been many methods proposed for the filling or coating of the resin into/onto the carrier core material. Japanese Patent Laid-Open No. 5-100492 discloses a carrier for developing an electrostatic charge image produced by mixing magnetic core particles with a coating resin in a dry state and then heating, melting and cooling the mixture, wherein a ferrite magnetic body having a specific surface area of 100 to 1,000 $cm^2/g$ is used and the surface coating ratio from the resin is set at 90% or more.

Japanese Patent Laid-Open No. 5-100492 recites in paragraph [0007] that "when producing by a resin coating method without using a solvent, not only is it impossible to obtain a uniform coating, but the interior of the coated portion contains a large amount of voids, whereby film strength is dramatically reduced. Further, if the surface is overly smooth, the anchor effect between the resin coating and the core particles is insufficient, which causes adhesion to deteriorate, whereby there is the problem that the occurrence of floating resin increases during production." While it is true that resin adhesion can be increased by mixing a ferrite core material which is somewhat uneven with a coating resin in a dry state and then heating, melting and cooling the mixture, a ferrite magnetic body having a specific surface area of at most about 1,000 $cm^2/g$ like that described in Japanese Patent Laid-Open No. 5-100492 has few voids, which makes it difficult to achieve a lower specific gravity of the carrier by making the resin permeate into the interior of the magnetic body.

Further, Japanese Patent Laid-Open No. 5-100492 lists various resins which can be used as the resin, and describes that as the carrier particle size, a broad range of 20 to 200 μm can be used. However, the working examples only contain examples of a fluorine resin and a St-MMA resin and particle size of 80 μm. Taking this into consideration, it may be judged that there is no technical suggestion in Japanese Patent Laid-Open No. 5-100492 that a carrier having a small particle size and a low specific gravity can be obtained by filling the void portions of porous ferrite with a resin having specific heat properties.

Japanese Patent Laid-Open No. 5-173371 discloses a carrier for developing an electrostatic charge image coated with core particles, wherein the coating resin contains a methylphenyl silicone polymer having a softening point of 50° C. or above and an absorbance ratio of methyl groups to phenyl groups measured by an IR spectrophotometer in the range of 0.6 to 3.0. This publication also discloses a method for producing a carrier for developing an electrostatic charge image by mixing the coating resin and core particles in a dry state, then heating to melt the coating resin and coating the core particles.

Japanese Patent Laid-Open No. 5-173371 describes coating a specific resin, in which the proper blending amount of the coating resin is about 0.3 to 10% by weight, and preferably 0.5 to 3% by weight. Further, in the working examples the resin amount is at most about 2% by weight. Japanese Patent Laid-Open No. 5-173371 also describes that the ratio of methyl groups to phenyl groups is preferably within a specific range. The reason for this is described as being that if a silicone polymer is used having a ratio of methyl groups to phenyl groups of less than 0.6 but a softening point of 50° C. or above, crosslinking by residual OH groups tends to proceed, it is difficult to obtain a uniform coat by a heating-melting-coating method and peeling tends to occur, and that if a silicone polymer is used having the above-described ratio of 0.6 or more but a softening point of less than 50° C., polymerization tends to be insufficient, a large number of low-molecular weight polymers are included and agglomeration during production or carrier agglomeration after coating tends to occur.

As can be understood from this, Japanese Patent Laid-Open No. 5-173371 merely discloses a resin-coated carrier, and contains no suggestion of the resin-filled carrier like that of the present invention.

Japanese Patent Laid-Open No. 2002-91091 is directed to providing a carrier which can realize high durability and high productivity even while being a resin-coated carrier which can be manufactured at a low cost with high safeness for the environment, and discloses a carrier having on a carrier core material a polyoxyalkylene-modified polyorganosilsesquioxane resin-coated layer which has an amino group, a polyoxyalkylene group and alkoxy group in one molecule.

Further, the proper blending amount of the coating resin is described as being about 0.3 to 10% by mass, preferably 0.05% by mass or more, more preferably 0.1 to 10% by mass and still more preferably 0.2 to 5% by mass. However, Japanese Patent Laid-Open No. 2002-91091 is merely directed to coating on a surface. If the above-described resin is used with such method, sufficient durability cannot be obtained because of the high specific gravity of the resin.

Thus, there is a need for a resin-filled carrier which, while maintaining the advantages of the above-described resin-filled carriers, has stable charging properties when used as a developer, is free from image defects such as white spots and has good production stability.

Accordingly, it is an object of the present invention to provide a resin-filled ferrite carrier for an electrophotographic developer which, while maintaining the advantages of a resin-filled carrier, has stable charging properties when used as a developer, is free from image defects such as white spots and has good production stability, a production method thereof and an electrophotographic developer using this ferrite carrier.

SUMMARY OF THE INVENTION

As a result of extensive studies into resolving the above-described problems, the present inventors discovered that by using as the filling resin a silicone resin having specific heat properties, and using a specific filling method, there are scarcely any resin microparticles present in a floating state without adhering to the porous ferrite core material, and that the above-described objectives could be achieved by having scarcely any floating resin microparticles, thereby arriving at the present invention.

Specifically, the present invention provides a resin-filled ferrite carrier for an electrophotographic developer filled with a resin in voids of a porous ferrite core material, wherein the resin filled in the voids is a silicone resin which has a softening point of 40° C. or above and is cured at or above such softening point, and the filled amount is 7 to 30 parts by weight based on 100 parts by weight of the core material.

In the resin-filled ferrite carrier for an electrophotographic developer according to the present invention, the softening point of the silicone resin is preferably 50 to 100° C.

In the resin-filled ferrite carrier for an electrophotographic developer according to the present invention, the curing of the silicone resin is preferably curing by a dehydration condensation reaction.

In the resin-filled ferrite carrier for an electrophotographic developer according to the present invention, the filled amount of the silicone resin is preferably 12 to 20 parts by weight based on 100 parts by weight of the core material.

In the resin-filled ferrite carrier for an electrophotographic developer according to the present invention, the silicone resin is preferably a polyorganosilsesquioxane, and polymethylsilsesquioxane is especially preferred.

In the resin-filled ferrite carrier for an electrophotographic developer according to the present invention, the silicone resin preferably has a heat loss at 350° C. of less than 10% by weight.

The resin-filled ferrite carrier for an electrophotographic developer according to the present invention preferably has a volume average particle size of 20 to 50 μm, a saturated magnetization of 30 to 80 $Am^2/kg$, a true density of 2.5 to 4.5 $g/cm^3$, an apparent density of 1.0 to 2.2 $g/cm^3$, and 5% or less by volume of particles having a diameter of less than 24 μm.

In the resin-filled ferrite carrier for an electrophotographic developer according to the present invention, a composition of the porous ferrite core material preferably comprises at least one selected from the group consisting of Mn, Mg, Li, Ca, Sr, Cu and Zn.

The present invention also provides a method for producing a resin-filled ferrite carrier for an electrophotographic developer filled with a resin in voids of a porous ferrite core material, by mixing and stirring a resin solution obtained by dissolving a silicone resin having a softening point of 40° C. or above in a solvent with the porous ferrite core material, volatizing the solvent, then heating the mixture while increasing the temperature to a temperature at or above the softening point, maintaining at that temperature to soften and melt the resin, and then increasing the temperature to at or above the curing temperature of the resin to cure the resin.

The present invention also provides an electrophotographic developer comprising the above-described resin-filled ferrite carrier for an electrophotographic developer and a toner.

Since the resin-filled ferrite carrier for an electrophotographic developer according to the present invention is a resin-filled ferrite carrier, true density is lighter, a longer life can be achieved, fluidity is excellent and charge amount and the like can be easily controlled. Further, the resin-filled ferrite carrier is stronger than a magnetic powder-dispersed carrier, and yet does not split, deform or melt from heat or shocks. Further, by using a silicone resin having specific heat properties for the resin-filled ferrite carrier, since there are scarcely any resin microparticles in a floating state without closely adhering to the porous ferrite core material, when used as a developer, such developer has stable charge properties, and is free from the occurrence of image defects such as white spots. In addition, according to the production method of the present invention, the above-described resin-filled ferrite carrier can be obtained with good production stability.

DETAILED DESCRIPTION OF THE PREFERRED EMBODIMENTS

Preferred embodiments for carrying out the present invention will now be described.

<Resin-filled Ferrite Carrier for an Electrophotographic Developer According to the Present Invention>

The resin-filled ferrite carrier for an electrophotographic developer according to the present invention has a resin filled in the voids of a porous ferrite core material, and uses a silicone resin as this resin. Such a silicone resin-filled ferrite carrier has a lighter true density, can achieve a longer life and has excellent fluidity. In addition, control of charge amount and the like can be easily carried out. Further, this silicone resin-filled ferrite carrier is stronger than a magnetic powder-dispersed carrier, and yet does not split, deform or melt from heat or shock. In addition, not only can the silicone resin obtain a certain degree of hardness, but since surface tension is low, contamination (toner spent) when used as a carrier can be alleviated.

The silicone resin used in the present invention has a softening point of 40° C. or above, and is cured at or above such softening point. Here, the term "softening point" refers to the temperature at which a heated substance (silicone resin) softens and deforms. The reason why the softening point of the silicone resin must be 40° C. or above is that the resin is preferably a solid at room temperature in consideration of ease of mixing with the porous ferrite core material and handling during production. If the softening point of the silicone resin is less than 40° C., the resin starts to melt under the hot and humid conditions of summer, whereby handling and ease of mixing worsen.

During the process of producing the resin, the resin may also be extracted without forming into a solid while still in a liquid state diluted with an organic solvent. The softening point in this case may be such that the softening point of the resin solid remaining after the organic solvent has been volatilized is 40° C. or above. If the softening point is less than 40° C., the resin solid which is in a floating state tends not to mix with the carrier particles filled with resin in the below-described "two-stage filling", and is thus not preferable.

The upper limit of the softening point of the silicone resin used in the present invention is not especially limited, so long as it is below the curing temperature. However, since crosslinking reactions (a dehydration condensation reaction) of silicone resins generally start from about 150° C., the softening point is preferably at or below this temperature, and most preferably is 50 to 100° C.

A resin having a softening point starts to soften at its softening point in conjunction with increasing temperature, and then melts. Since viscosity rapidly decreases (becomes more fluid) if the resin melts, the resin permeates into voids in the porous ferrite core material. Therefore, in the present invention, the silicone resin is preferably such that this melting, or fluid state, suitably occurs. The temperature at which this fluidity starts (fluid point) will obviously be higher than the softening point and lower than the curing temperature.

The above-described curing of the silicone resin used in the present invention preferably occurs by a dehydration condensation reaction. It is a known fact that the curing (crosslinking) modes of silicone resins are usually peroxide crosslinking, condensation crosslinking and addition-reaction crosslinking.

Among these crosslinking modes, in peroxide crosslinking byproducts such as alcohol and carboxylic acid are always produced during the crosslinking reaction. When such byproducts are produced, voids and gaps occur in the resin filled in the porous ferrite core material interior, so that the strength of a filled carrier tends to decrease, which is not preferable. In addition, there is also a concurrent large change in volume, which is a factor in triggering a reduction in the strength of a filled carrier.

A hydrosilylation crosslinking reaction, which is an addition crosslinking reaction, is said to be suitable for resin-filled ferrite carriers such as that of the present invention, due to the features of not producing byproducts during curing and the absence of a volume change before and after curing. However, this crosslinking reaction scarcely proceeds unless a catalyst is present. Therefore, generally a platinum compound is used as a catalyst. However, to carry out the below-described "two-stage filling" or "melt filling", it is necessary to maintain the non-cured state for a certain amount of time. On the other hand, to maintain the non-cured state for a certain amount of time in a hydrosilylation crosslinking reaction, although measures such as using together with a curing retarder can be taken, the control of such measures involves a high degree of difficulty. In the case of using in a resin-filled ferrite carrier such as that of the present invention, problems such as the resin curing before being filled would be expected to arise.

Depending on the type of crosslinking agent used, the condensation crosslinking may be a dealcohol type, deacetic acid type, deoxime type, or deacetone type reaction. However, in each of these cases the amount of produced byproducts is large, which is not preferable. Further, these reactions proceed comparatively quickly, and are thus not preferable from the standpoint of maintaining a non-cured state for a certain amount of time like in the present invention.

In the present invention, the most preferred crosslinking mode is, even among the condensation crosslinking types, dehydration condensation occurring among the silanol groups which are already contained in the silicone resin. Although water is produced as a byproduct, this can be reduced to a level having no adverse impact by adjusting the amount of resin silanol groups. Further, since this reaction proceeds more slowly than all of the other above-described crosslinking reactions, it is preferable from the standpoint of maintaining a non-cured state for a certain amount of time.

It is desirable for the resin-filled ferrite carrier for an electrophotographic developer according to the present invention to be filled with 7 to 30 parts by weight of silicone resin, preferably 10 to 30 parts by weight, and especially preferably 12 to 20 parts by weight, based on 100 parts by weight of the porous ferrite core material. If the filled amount of silicone resin is less than 7 parts by weight, it is difficult to achieve a reduction in specific gravity. If the filled amount of silicone resin is more than 30 parts by weight, although a reduction in specific gravity can be achieved, because the carrier resistance is too high, it is difficult to obtain image density, and is thus not preferable.

The silicone resin used in the present invention is preferably a polyorganosilsesquioxane. Silicone resins are composed from four basic structural units: M units (monofunctional); D units (bifunctional); T units (trifunctional); and Q units (tetrafunctional). Silicone resins used as a coating resin are typically constituted from T units and D units. Resins referred to as a so-called "DT resin" make up most of these resins. The greater the amount of T units, the higher the crosslinking density, the faster the curing, the smaller the heat loss and the harder and more brittle the resin becomes. Therefore, if used as a normal coating resin, there is the problem that the coating will peel due to stress from inside the developing machine. Thus, the resin used for coating is constituted from T and D units in a suitable ratio. The present invention comprises a first characteristic of filling a resin into voids of a porous ferrite core material. Since the filled resin is not subjected to direct stress from inside the developing machine, problems such as those which occur when used as a coating resin do not arise. To the contrary, thanks to the qualities of fast curing, a small heat loss and being hard, the splitting of the carrier particles themselves due to stress from inside the developing machine can be prevented.

Among polyorganosilsesquioxanes, polymethylsilsesquioxane is especially preferable. Silicone resins are classified into three types, methyl, phenyl and methylphenyl, based on the difference in organic group which the silicon atom has. Generally, the larger the phenyl group content, the harder the coating is, but the condensation rate becomes slower and the thermoplastic nature tends to become more pronounced. Further, because phenyl groups have a larger number of carbon atoms, heat loss is usually large. Therefore, considering the filling of the resin into the voids of the porous ferrite core material, a phenyl silicone resin, which has a slow condensation rate and a large heat loss, is not preferable. In addition, while the critical surface tension of a phenyl group is about 35 dyne/cm, the critical surface tension of a methyl group is about 20 dyne/cm, which means that methyl groups have higher water repellency. Also, from the perspective of environmental (humidity) dependency of the frictional charge with the toner, it can be said that a methyl-type silicone resin is preferable. As described above, phenyl groups have a high critical surface tension and good compatibility with the organic group, and thus a methyl resin is also better against contamination of the carrier surface from toner.

The amount of byproducts produced from crosslinking of the silicone resin used in the present invention is found by measuring the heat loss. Here, the heating temperature after the resin has been filled is at most about 350° C. even if a thermosetting silicone resin is used. Therefore, the heat loss at 350° C. is preferably less than 10% by weight, and is especially preferably 7% by weight or less. If the heat loss is more than 10% by weight, a greater number of voids and holes are formed in the filled carrier interior, whereby the strength of the carrier is reduced. On the other hand, if the heat loss is less than 2% by weight, the amount of reacting silanol groups is small, thereby reducing the crosslinking density, which becomes a factor in reducing strength. Therefore, the most preferred range is 2 to 7% by weight.

A conductive agent may be added to the silicone resin to be filled in order to control the electric resistance of the ferrite carrier and the charge amount and charge speed. Since the electric resistance of the conductive agent is itself low, there is a tendency for a charge leak to suddenly occur if the added amount is too large. Therefore, the added amount is 0.25 to 20.0% by weight, preferably 0.5 to 15.0% by weight and especially preferably 1.0 to 10.0% by weight, of the solid content of the filled resin. Examples of the conductive agent include conductive carbon, oxides such as titanium oxide and tin oxide, and various organic conductive agents.

In the above-described silicone resin, a charge control agent can be contained. Examples of the charge control agent include various charge control agents generally used for toners and various silane coupling agents. This is because, although the charging capability is sometimes reduced if a large amount of resin is filled, it can be controlled by adding the charge control agent or the silane coupling agent. The charge control agents and coupling agents which may be used are not especially limited. Preferable examples of the charge control agent include a nigrosin dye, quaternary ammonium salt, organic metal complex and metal-containing monoazo dye. Preferable examples of the silane coupling agent include an aminosilane coupling agent and fluorinated silane coupling agent.

The resin-filled ferrite carrier for an electrophotographic developer according to the present invention has an average particle size of 20 to 50 μm. Within this range, carrier adhesion can be prevented and good image quality can be obtained. If the average particle size is less than 20 μm, carrier adhesion occurs more easily, and thus is not preferable. If the average particle size is more than 50 μm, image quality tends to deteriorate, and thus is not preferable.

The resin-filled ferrite carrier for an electrophotographic developer according to the present invention preferably has a saturated magnetization of 30 to 80 $Am^2/kg$, and more preferably 50 to 70 $Am^2/kg$. If the saturated magnetization is less than 30 $Am^2/kg$, it is easier for carrier adhesion to be induced. If the saturated magnetization is more than 80 $Am^2/kg$, the bristles of the magnetic brush stiffen, which makes it difficult to obtain high image quality, and is thus not preferable.

The resin-filled ferrite carrier for an electrophotographic developer according to the present invention preferably has a true density of 2.5 to 4.5 $g/cm^3$, more preferably 2.8 to 4.0 $g/cm^3$, and most preferably 3.0 to 4.0 $g/cm^3$. If the true density is less than 2.5 $g/cm^3$, the true density of the carrier is too low and fluidity deteriorates, whereby charging speed is reduced and the magnetization per particle decreases too much, which is a cause in carrier adhesion. If the true density is more than 4.5 $g/cm^3$, the true density is too high, so that a longer life cannot be achieved because of stress during use.

The resin-filled ferrite carrier for an electrophotographic developer according to the present invention preferably has an apparent density of 1.0 to 2.2 $g/cm^3$. If the apparent density is less than 1.0 $g/cm^3$, the shape is poor and protruding portions tend to increase. These portions are weak against mechanical stress and are brittle, thereby reducing strength, whereby the carrier tends to break. If the apparent density is more than 2.2 $g/cm^3$, it is difficult to achieve a longer life.

The resin-filled ferrite carrier for an electrophotographic developer according to the present invention preferably has a volume of particles which are less than 24 μm of 5% or less. If the volume of particles less than 24 μm is more than 5%, carrier adhesion tends to be induced. It is especially preferable for the particles less than 24 μm to be 2% by volume or less.

The composition of the core material of the resin-filled ferrite carrier for an electrophotographic developer according to the present invention preferably comprises at least one selected from the group consisting of Mn, Mg, Li, Ca, Sr, Cu and Zn. Considering the recent trend towards reducing environmental burden, such as restrictions on waste products, it is preferable for the heavy metals Cu, Zn and Ni to be contained in an amount which does not exceed the scope of unavoidable impurities (accompanying impurities).

The BET specific surface area of the resin-filled ferrite carrier for an electrophotographic developer according to the present invention is preferably 2,000 $cm^2/g$ or more. If the specific surface area is less than 2,000 $cm^2/g$, a reduction in specific gravity cannot be achieved even by filling the resin, and is thus not preferable. Preferred is 2,500 $cm^2/g$ or more. If the specific surface area is more than 8,000 $cm^2/g$, there are too many voids, which makes it difficult to obtain sufficient strength even by filling the resin. Preferred is 7,000 $cm^2/g$ or less. Therefore, the preferable BET specific surface area range is 2,000 to 8,000 $cm^2/g$, and especially preferable is 2,500 to 7,000 $cm^2/g$.

The silicone resin-filled ferrite carrier according to the present invention may be coated with a resin. The coating resin is not especially limited. Examples include a fluororesin, acrylic resin, epoxy resin, polyamide resin, polyamideimide resin, polyester resin, unsaturated polyester resin, urea resin, melamine resin, alkyd resin, phenol resin, fluoroacrylic resin, acryl-styrene resin, silicone resin, and a modified silicone resin modified by an acrylic resin, polyester resin, epoxy resin, polyamide resin, polyamideimide resin, alkyd resin, urethane resin, fluororesin or the like. Taking into consideration detachment of the resin due to mechanical stress during use, a thermosetting resin is preferably used. Specific examples of the thermosetting resin include an epoxy resin, phenol resin, silicone resin, unsaturated polyester resin, urea resin, melamine resin, alkyd resin, and a resin containing these. The coated amount of the resin is preferably 0.5 to 5.0 parts by weight based on 100 parts by weight of the silicone resin-filled ferrite carrier (before resin coating).

<Measurement Methods>

The measurement methods for the respective physical properties of the resin-filled ferrite carrier according to the present invention will be described below.

(Average Particle Size)

The average particle size was measured using a Microtrac Particle Size Analyzer (Model: 9320-X100), manufactured by Nikkiso Co., Ltd. Water was used for the dispersing solvent. A 100 mL beaker was charged with 10 g of a sample and 80 mL of water, and then 2 to 3 drops of a dispersant (sodium hexametaphosphate) were added therein. Next, using the ultrasonic homogenizer (Model: UH-150, manufactured by SMT Co. Ltd.), the output was set to level 4, and dispersing was carried out for 20 seconds. Then, the bubbles formed on the surface of the beaker were removed, and the sample was charged into the analyzer. The volume percentage of particles smaller than 24 μm was also calculated by measuring in the same manner.

(Magnetic Properties)

Saturated magnetization was measured using an integral-type B-H tracer BHU-60 (manufactured by Riken Denshi Co., Ltd.). An H coil for measuring magnetic field and a 4 πI coil for measuring magnetization were placed in between electromagnets. In this case, the sample was put in the 4 πI coil. The outputs of the H coil and the 4 πI coil when the magnetic field H was changed by changing the current of the electromagnets were each integrated; and with the H output as the X-axis and the 4 πI coil output as the Y-axis, a hysteresis loop was drawn on recording paper. The measuring conditions were a sample filling quantity of about 1 g, the sample filling cell had an inner diameter of 7 mm±0.02 mm and a height of 10 mm±0.1 mm, and the 4 πI coil had a winding number of 30.

(True Density)

The true density of the carrier particles was measured according to JIS R9301-2-1 by using a picnometer. Here, methanol was used as the solvent, and the measurement was carried out at a temperature of 25° C.

(Apparent Density)

The apparent density was measured according to JIS Z2504 (Apparent density test method for metal powders).

(Transmittance (Floating Resin Amount))

Transmittance, which represents the amount of floating resin, was measured according to the following method.

The visible spectrophotometer Model 16100 (manufactured by Ogawa Seiki Co., Ltd.) was used as the measuring apparatus. A glass cell (Model: MG-10, manufactured by Fuijiwara Scientific Company Co., Ltd.) was charged with 3 mL of MEK, and then placed into the cell holder. The wavelength selector was set to 500 nm. The sample chamber was closed, and then the "Calibrate" button was pushed (the transmittance obtained from this operation was taken as 100%).

15 g of a carrier sample was weighed out and charged into a 50 mL sample bottle. The bottle was then charged with 20 mL of MEK, and then the lid was closed. The sample bottle was attached to a rotary stirrer, and the mixture was stirred for 20 minutes at 150 rpm. Next, a magnet was placed on the bottom of the sample bottle, and the carrier sank. The sample bottle was shaken three times by hand in this state. An empty glass cell was then charged with 3 mL of the supernatant solution.

The cell containing the sample (supernatant solution) was placed in the cell holder, and the sample chamber was closed. The value shown on the measuring apparatus display was read to measure the transmittance.

The lower the transmittance value, the greater the amount of floating resin that is indicated. A transmittance of less than 90% indicates a large amount of floating resin, and a transmittance of less than 85% indicates a very large amount of floating resin.

(Heat Loss)

Heat loss was measured using a differential thermal analyzer ("TG-DTA 2000S", manufactured by Bruker AXS K.K.).

10 mg of a sample (resin powder) was weighed into a platinum cell. The platinum cell containing the sample was placed in the above differential thermal analyzer, and heated from room temperature to 800° C. at a rate of temperature increase of 5° C. per minute. At this stage, an air atmosphere served as the measuring atmosphere, and the amount of air pumped in was 150 mL/min.

The change in weight during the heating to 800° C. was measured, and the drop in weight at 350° C. was taken as the heat loss (% by weight).

In the case of a liquid-state resin, first the diluting solvent is volatilized. At this stage, the heating must be at a temperature that is sufficiently lower than the temperature at which the resin cures. The resin solid remaining after the diluting solvent has been volatilized is subjected to the same procedures as described above for measuring heat loss.

(BET Specific Surface Area)

The BET specific surface area of the porous ferrite core material was measured using the "Micromeritics Automatic Surface Area Analyzer GEMINI 2360" (manufactured by Shimadzu Corporation). The measuring tube that was used had straight tube portion outer diameter of 9.5 mm, a sample receptacle portion outer diameter of 19 mm, a length of 38 mm and a sample capacity of about 6.0 $cm^3$. Prior to measuring, baking was carried out for 1 hour at 200° C. under a nitrogen atmosphere. About 10 to 15 g of carrier particles were placed in the measuring tube, which was then correctly weighed by a precision balance. $N_2$ gas was made to adhere to the carrier particles, and the adhered amount was measured. The measurement was carried out using a ten point method. The BET specific surface area is automatically calculated by inputting the weight of the sample when the measurement finished.

(Resin Softening Point)

Measurement of the softening point was carried out according to the softening point measuring method described in JIS K5601-2-2 (ring and ball method).

(Charge Properties)

The charge amount was measured using a mixture of carrier and toner by a suction type charge measurement device (Eppingq/m-meter, manufactured by PES-Laboratorium). As the toner, a commercially available negative toner used in full-color printers (cyan toner for DocuPrint C3530, manufactured by Fuji Xerox Co., Ltd.) was used, and the toner concentration was adjusted to 5% by weight. The adjusted developer was charged into a 50 cc glass bottle and then stirred at a speed of 100 rpm.

Here, the charge amount after stirring with the toner for respectively 3, 5, 30 and 240 minutes was measured. These results are represented using three levels of, in order from smallest change in charge amount, ○, Δ and ×.

<Method for Producing the Resin-filled Ferrite Carrier for an Electrophotographic Developer According to the Present Invention>

The method for producing the resin-filled ferrite carrier for an electrophotographic developer according to the present invention will now be described.

To produce the resin-filled ferrite carrier for an electrophotographic developer according to the present invention, the raw materials are appropriately weighed, and then the resultant mixture is crushed and mixed by a ball mill, vibration mill or the like for 0.5 hours or more, and preferably for 1 to 20 hours. The resultant crushed material is pelletized using a pressure molding machine or the like, and calcined at a temperature of 700 to 1,200° C. This may also be carried out without using a pressure molding machine, by after the crushing adding water to form a slurry, and then granulating using a spray drier. The calcined material is further crushed by a ball mill, vibration mill or the like, and then charged with water, and optionally with a dispersant, a binder or the like to adjust viscosity. The resultant solution is granulated, and held at a temperature of 1,000 to 1,500° C. for 1 to 24 hours while the oxygen concentration is controlled to carry out sintering. In the case of crushing after calcination, the calcined material may be charged with water and crushed by a wet ball mill, wet vibration mill or the like.

The above crushing machine such as the ball mill or vibration mill is not especially limited, but, for uniformly and effectively dispersing the raw materials, preferably uses fine beads having a particle size of 1 mm or less as the media to be used. By adjusting the size, composition and crushing time of the used beads, the crushing degree can be controlled.

The resultant sintered material is crushed and classified. The particles are adjusted to a desired size using a conventionally-known classification method, such as air classification, mesh filtration and precipitation.

Thereafter, the electric resistance can be optionally adjusted by heating the surface at a low temperature to carry out an oxide film treatment. The oxide film treatment may be conducted using a common furnace such as a rotary electric furnace or batch-type electric furnace, and the heat-treatment may be carried out, for example, at 300 to 700° C. The thickness of the oxide film formed by this treatment is preferably 0.1 nm to 5 μm. If it is less than 0.1 nm, the effect of the oxide film is small. If it is more than 5 μm, the magnetization may decrease, and the resistance may become too high, which makes it difficult to obtain the desired properties. Reduction may optionally be carried out before the oxide film treatment.

Various methods may be used for filling the silicone resin into the resultant resin-filled ferrite carrier for an electrophotographic developer. Examples thereof include a dry method, spray-dry method using a fluidized bed, rotary-dry method, and liquid immersion-dry method using a universal stirrer.

Further examples include the methods disclosed in the above-described patent publications. However, if such methods and the resins described in these patent publications are used, when an attempt is made to fill 7 to 30 parts by weight of resin based on 100 parts by weight of core material into the interior of the porous ferrite core material, some of the resin which is supposed to be filled into the interior is not filled, and remains in a non-closely adhered state (floating state) with the porous ferrite core material, as a result of shocks with the stirring mechanism in the apparatus and friction between the particles during the filling step. If a resin-filled ferrite carrier in such a state is used, problems like those described above (image defects such as charge hindrance and white spots, and lack of production stability) arise.

One example of a such a conventional method is to prepare a resin solution of the widely-used condensation crosslinking silicone resin SR-2411, and then mix and stir this resin solution with the porous ferrite core material a) under reduced pressure, or b) under heating at a temperature at which the organic solvent volatilizes, or c) under reduced pressure and under heating. By mixing and stirring in this state, the resin solution permeates into the porous ferrite core material interior. Since the organic solvent volatilizes while the resin solution permeates, the resin (solids) remains in the interior of the porous ferrite core material, or in other word is "filled". However, since part of the resin solution remains in such state on the surface of the porous ferrite core material, the resin attached to the surface peels off due to stirring stress or friction between the particles. Resin which has peeled off in this way becomes "floating resin". Then, a heat treatment is carried out at a temperature at or higher than the curing temperature of the resin, whereby the resin is cured. However, the "floating resin" is cured while still floating without closely adhering to the porous ferrite core material.

Thus, in the present invention, a specific silicone resin (solid matter) having a softening point of 40° C. or above is dissolved in an organic solvent (toluene, IPA and the like), and the obtained resin solution is mixed and stirred with the porous ferrite core material a) under reduced pressure, or b) under heating at a temperature at which the organic solvent volatilizes, or c) under reduced pressure and under heating. The resin is subsequently filled in the same manner as the above-described conventional method. As with the conventional method, "floating resin" is produced at the stage where the resin has finished being filled.

Then, heating is carried out at or above the "softening point" of the silicone resin used in the present invention. If the temperature is at or above the "softening point", the floating resin softens, and eventually, melts. If held in a melted state for a while, the resin which had been "floating" permeates into the porous ferrite core material interior. Then, the temperature is increased to the curing temperature or above. By doing this, the silicone resin is cured in the porous ferrite core material interior. Since the cured silicone resin is strongly and closely adhered to the porous ferrite core material, it does not turn into floating resin.

Here, another possible method is to mix the resin solids and the porous ferrite core material from the start, then dissolve the resin by heating to make the it permeate into the porous ferrite core material interior. Resin can be filled without any "floating resin" being produced even by such a method. However, although the resin can permeate and be filled deep into the porous ferrite core material because the viscosity of the resin solution decreases if the resin is dissolved and filled in the above-described manner, if the resin solids are mixed and heated with the porous ferrite core material, these advantageous effects cannot be obtained. Specifically, the preferred mode is "two-stage filling" in which after filling has been carried out once, the produced floating resin is meted and filled.

Resins which allow such "two-stage filling" or "melt filling" must have a softening point and cure at a temperature which is at equal to above that point.

This heating may be performed using external heating or internal heating, and may use, for example, a fixed-type or flow-type electric furnace, rotary electric furnace or burner furnace. The heating may even be performed by baking using microwaves. Although the temperature depends on the resin to be filled, by increasing the temperature to the point where sufficient curing proceeds, a resin-filled ferrite carrier which is strong against shocks can be obtained.

A conventionally-known method may be used to further coat a resin onto the above-described ferrite carrier already filled with a silicone resin. Examples of such coating methods include brush coating, dry method, spray-dry method using a fluidized bed, rotary-dry method and liquid immersion-dry method using a universal stirrer. To improve the coating efficiency, a method using a fluidized bed is preferable. The coating resin is as described above.

After the ferrite carrier already filled with a silicone resin has been coated with a resin, baking may be carried out by either external heating or internal heating. The baking can be carried out using, for example, a fixed-type or flow-type electric furnace, rotary electric furnace, burner furnace, or even by using microwaves. In the case of using a UV-curable resin, a UV heater is used. Although the baking temperature depends on the resin which is used, the temperature must be equal to or higher than the melting point or the glass transition point. For a thermosetting resin or a condensation-crosslinking resin, the temperature must be increased to a point where sufficient curing proceeds.

The present invention will now be explained in more detail based on the following examples.

EXAMPLE 1

Raw materials were weighed out in a ratio of 35 mol % of MnO, 14.5 mol % of MgO, 50 mol % of $Fe_2O_3$ and 0.5 mol % of SrO. The resultant mixture was crushed for 5 hours by a wet media mill to obtain a slurry. This slurry was dried by a spray dryer to obtain spherical particles. To adjust the void fraction which is formed, manganese carbonate was used for the MnO raw material and magnesium hydroxide was used for the MgO raw material.

The obtained particles were heated for 2 hours at 950° C. to carry out calcination. Subsequently, to obtain an appropriate fluidity while increasing the void fraction, the particles were crushed for 1 hour by a wet ball mill using stainless steel beads ⅛ inch in diameter, and then crushed for a further 4 hours using stainless steel beads 1/16 inch in diameter. The resultant slurry was charged with an appropriate amount of dispersant. The slurry was also charged with 1% by weight of PVA (20% aqueous solution) based on solid content as a binder to ensure the strength of the particles to be granulated and to adjust the void fraction. The slurry was then granulated and dried by a spray drier. The resultant particles were adjusted for particle size, and then heated for 2 hours at 650° C. to remove the organic components such as the dispersant and the binder. Then, the resultant particles were held at a temperature of 1,100° C. at an oxygen concentration of 0 vol. % for 4 hours in an electric furnace to carry out sintering. Then, the sintered material was crushed and further classified for particle size adjustment. Low magnetic particles were then separated off by magnetic separation to obtain a core material for porous ferrite particles. The volume average particle size of this ferrite core material was 35.1 μm. In addition, the BET specific surface area was measured at 4,604 $cm^2/g$.

Next, a resin solution was prepared in the following manner.

As the resin to be filled in the voids of the above-described porous ferrite, polymethylsilsesquioxane was prepared which had a softening point of 65° C., a melt viscosity at 150° C. of about 500 cp, a curing start temperature of about 150° C. and a heat loss at 350° C. of 5.4% by weight.

1,800 g of the above-described resin (solids) was dissolved in 7,200 g of toluene to blend a resin solution. This resin solution and 10 kg of the above-described porous ferrite particles were mixed and stirred at 60° C. under a reduced pressure of 2.3 kPa. While volatizing the toluene, the resin permeated into the porous ferrite core material interior and was filled therein.

The pressure in the vessel was returned to ordinary pressure. Once it was confirmed that the toluene had sufficiently volatilized, the interior of the stirrer was visually observed, whereby the mixture could be seen to have very good fluidity without any sense of dampness. While continuing to stir at ordinary pressure, the heating medium temperature of the stirrer was increased to 120° C. at a rate of temperature increase of 2° C. per minute. During this stage, at the point where the stirrer interior reached a heating medium temperature of 100° C., the resin was in a viscous state due to melting.

The heating medium temperature of the stirrer was further increased to 220° C. at a rate of temperature increase of 2° C. per minute. The resin was cured by stirring while heating at this temperature for 60 minutes. After 60 minutes, the temperature of the ferrite particles themselves was measured using a contact thermometer to be 207° C.

Then, the mixture was cooled to room temperature, and the ferrite particles which had been filled with a resin and cured were removed. Particle agglomerates were broken up using a vibrating sieve with 150 mesh apertures. Using a magnetic separator, non-magnetic matter was removed. Then, again using the magnetic separator, coarse particles were removed to obtain a resin-filled ferrite carrier filled with resin.

These particles were mixed to obtain a resin-filled ferrite carrier. The volume average particle size of the obtained carrier was measured to be 38.3 μm and transmittance (floating resin amount) was 93.2%. Other carrier properties and evaluation results are shown in Tables 1 and 2. The measurement methods were as described above.

In addition, the volume average particle size and transmittance (floating resin amount) of the carriers obtained in the following Example 2 and Comparative examples 1 and 2, as well as other carrier properties and evaluation results, are also shown in Tables 1 and 2.

EXAMPLE 2

A resin-filled ferrite carrier was produced in the same manner as in Example 1, except that the amount of filled resin (solids) was changed from 1,800 g to 1,200 g.

COMPARATIVE EXAMPLE 1

The same porous ferrite particles used in Example 1 were used as the ferrite core material.

To clarify the difference with the carrier described in Japanese Patent Laid-Open No. 2004-77568, the experiment was carried out using a coating resin which was as similar as possible to that described in that publication.

Specifically, first BR-83 (molecular weight of about 40,000) manufactured by Mitsubishi Rayon Co., Ltd. was prepared as the methyl methacrylate (MMA). 300 g of this resin was dissolved in 10 kg of toluene, and the resultant mixture was then heated while stirring together with 10 kg of the above-described ferrite core material, whereby the toluene volatilized. This step was repeated twice to obtain ferrite particles which had been MMA-treated.

Next, the resin solution was prepared so that the coat had a thickness of about 0.5 μm by adding 200 g of SR-2411 (manufactured by Dow Corning Toray Co., Ltd.) in terms of solid content as the silicone resin, and based on the solid content of the resin, 5.5% by weight of carbon (Ketjenblack EC, manufactured by Ketjenblack International Corporation) and 10% by weight of γ-aminopropylaminoethyltriethoxysilane, and then adding toluene so that the solution had a solid content of 5%.

10 kg of the above-described methyl methacrylate-treated ferrite particles was placed in a fluidized bed coater, and the above-described resin solution was coated under a 90° C. atmosphere. After the resin was coated, the particles were removed from the vessel, and then heat treated for 2 hours at a temperature of 200° C. by a stationary heater. The ferrite particles which had been coated with a resin and cured were removed. Particle agglomerates were broken up using a vibrating sieve with 150 mesh apertures. Using a magnetic separator, non-magnetic matter was removed. Then, again using the magnetic separator, coarse particles were removed to obtain a resin-filled ferrite carrier.

The resin solid content amount (total of the methyl methacrylate and silicone resin solid content) used to treat the ferrite particles was in total 800 g based on 10 kg of ferrite particles, and 8% by weight based on the ferrite core material.

COMPARATIVE EXAMPLE 2

The same porous ferrite particles used in Example 1 were used as the ferrite core material. Mixed together were 10 kg of this porous ferrite core material, 2.2 kg of the above-described SR-2411 in terms of solid content (since the resin solution had an SR-2411 solid content of 20%, the actual amount was 11 kg) and 200 g of γ-aminopropylaminoethyltriethoxysilane. The resultant resin solution was charged into a mixer that was equipped with a stirring blade and a heater, and the toluene was then volatilized while stirring the solution under an ordinary atmosphere at a temperature of 70° C. The resin permeated into the porous interior, and was filled therein.

The toluene was confirmed to have sufficiently volatilized, and the mixture was then stirred for another 5 minutes. The mixture was then removed and heated at 200° C. for 2 hours to cure the resin.

The ferrite particles which had been coated with a resin and cured were removed. Particle agglomerates were broken up using a vibrating sieve with 150 mesh apertures. Using a magnetic separator, non-magnetic matter was removed. Then, again using the magnetic separator, coarse particles were removed to obtain a resin-filled ferrite carrier.

TABLE 1

| | Resin amount | Volume average particle size (μm) | Amount present with particle size of less than 24 μm (% by volume) | Apparent density (g/cm$^3$) | True density (g/cm$^3$) | Saturated magnetization (Am$^2$/kg) |
|---|---|---|---|---|---|---|
| Ex. 1 | 18 wt % | 38.3 | 0.7 | 1.58 | 3.59 | 63 |
| Ex. 2 | 12 wt % | 36.1 | 0.8 | 1.72 | 3.87 | 65 |
| Com. Ex. 1 | 8 wt % | 38.2 | 2.5 | 1.98 | 4.55 | 67 |
| Com. Ex. 2 | 22 wt % | 46.8 | 2.2 | 1.53 | 3.37 | 60 |

TABLE 2

| | Transmittance (%) (floating resin amount) | Charge amount (μC/g) stirring time 3 minutes | Charge amount (μC/g) stirring time 5 minutes | Charge amount (μC/g) stirring time 30 minutes | Charge amount (μC/g) stirring time 240 minutes | Charge amount stability |
|---|---|---|---|---|---|---|
| Ex. 1 | 93.2 | 12.0 | 11.8 | 10.8 | 11.2 | ○ |
| Ex. 2 | 97.8 | 13.3 | 14.2 | 15.2 | 14.7 | ○ |
| Com. Ex. 1 | 85.1 | 12.8 | 28.9 | 39.1 | 9.1 | X |
| Com. Ex. 2 | 80.1 | 27.2 | 29.2 | 34.8 | 27.4 | Δ |

It is clear from the results shown in Table 2 that the resin-filled ferrite carriers described in Examples 1 and 2 have a high value for transmittance, which represents the amount of resin that is floating without closely adhering to the porous ferrite core material, meaning that there is scarcely any floating resin. On the other hand, the carriers described in Comparative examples 1 and 2 have a low transmittance, meaning that there is large amount of floating resin.

Also, in the measurement of charge amount, the resin-filled ferrite carriers described in Examples 1 and 2 showed almost no change in charge amount even if the stirring was carried out for an extended time, thus illustrating very good results. On the other hand, the carriers described in Comparative examples 1 and 2 suffered from charge inhibition from floating resin, so that the charge amount gradually increased as the stirring time was extended. If such a developer was actually used, the charge amount would vary dramatically depending on the stress in the apparatus being used, whereby it can easily be imagined that the desired level of image density or the like could not be stably maintained.

Further, in Comparative example 1, which had a low resin used amount of 8% by weight, carrier true density and apparent density were high, and the charge amount was decreasing from the latter half of the stirring time. This is considered as being due to a strong stirring stress as a result of the high density, thus causing a phenomenon wherein the toner component fused to the carrier surface, in other words, the occurrence of toner spent.

INDUSTRIAL APPLICABILITY

Since the resin-filled ferrite carrier for an electrophotographic developer according to the present invention is a resin-filled ferrite carrier, true density is lighter, a longer life can be achieved, fluidity is excellent and charge amount and the like can be easily controlled. Further, the resin-filled ferrite carrier is stronger than a magnetic powder-dispersed carrier, and yet does not split, deform or melt from heat or shocks. Further, by using a silicone resin having specific heat properties for a developer, since there are scarcely any resin microparticles in a floating state without closely adhering to the porous ferrite core material, when used as a developer, such developer has stable charge properties, and is free from the occurrence of image defects such as white spots. In addition, according to the production method of the present invention, the above-described resin-filled ferrite carrier can be produced with good production stability.

Accordingly, the present invention can be widely used in the fields of full color machines in which high quality images are demanded, as well as high-speed printers in which the reliability and durability of image sustainability are demanded.

What is claimed is:

1. A resin-filled ferrite carrier for an electrophotographic developer filled with a resin in voids of a porous ferrite core material, wherein the resin filled in the voids is a polyorganosilsesquioxane which has a softening point of 40° C. or above and is cured at or above such softening point, and the filled amount is 7 to 30 parts by weight based on 100 parts by weight of the core material.

2. The resin-filled ferrite carrier for an electrophotographic developer according to claim 1, wherein the softening point of the silicone resin is 50 to 100° C.

3. The resin-filled ferrite carrier for an electrophotographic developer according to claim 1, wherein the curing of the silicone resin is curing by a dehydration condensation reaction.

4. The resin-filled ferrite carrier for an electrophotographic developer according to any claim 1, wherein the filled amount of the silicone resin is 12 to 20 parts by weight based on 100 parts by weight of the core material.

5. The resin-filled ferrite carrier for an electrophotographic developer according to claim 1, wherein the polyorganosilsesquioxane is polymethylsilsesquioxane.

6. The resin-filled ferrite carrier for an electrophotographic developer according to claim 1, wherein the silicone resin has a heat loss at 350° C. of less than 10% by weight.

7. The resin-filled ferrite carrier for an electrophotographic developer according to claim 1, having a volume average particle size of 20 to 50 μm, a saturated magnetization of 30 to 80 $Am^2/kg$, a true density of 2.5 to 4.5 $g/cm^3$, an apparent density of 1.0 to 2.2 $g/cm^3$, and 5% or less by volume of particles having a diameter of less than 24 μm.

8. The resin-filled ferrite carrier for an electrophotographic developer according to claim 1, wherein a composition of the porous ferrite core material comprises at least one selected from the group consisting of Mn, Mg, Li, Ca, Sr, Cu and Zn.

9. A method for producing a resin-filled ferrite carrier for an electrophotographic developer filled with a resin in voids of a porous ferrite core material, by mixing and stirring a resin solution obtained by dissolving a polyorganosilsesquioxane having a softening point of 40° C. or above in a solvent with the porous ferrite core material, volatizing the solvent, then heating the mixture while increasing the temperature to a temperature at or above the softening point, maintaining at that temperature to soften and melt the resin, and then increasing the temperature to at or above the curing temperature of the resin to cure the resin.

10. An electrophotographic developer comprising the resin-filled ferrite carrier for an electrophotographic developer according to claim 1 and a toner.

11. An electrophotographic developer comprising the resin-filled ferrite carrier for an electrophotographic developer according to claim 2 and a toner.

12. An electrophotographic developer comprising the resin-filled ferrite carrier for an electrophotographic developer according to claim 3 and a toner.

13. An electrophotographic developer comprising the resin-filled ferrite carrier for an electrophotographic developer according to claim 4 and a toner.

14. An electrophotographic developer comprising the resin-filled ferrite carrier for an electrophotographic developer according to claim 5 and a toner.

15. An electrophotographic developer comprising the resin-filled ferrite carrier for an electrophotographic developer according to claim 6 and a toner.

16. An electrophotographic developer comprising the resin-filled ferrite carrier for an electrophotographic developer according to claim 7 and a toner.

17. An electrophotographic developer comprising the resin-filled ferrite carrier for an electrophotographic developer according to claim 8 and a toner.

* * * * *